US010973284B2

(12) United States Patent
Curtin

(10) Patent No.: US 10,973,284 B2
(45) Date of Patent: Apr. 13, 2021

(54) BUTTON ANCHOR AND BUTTON ATTACHMENT SYSTEM

(71) Applicant: Catherine C. Curtin, Babylon, NY (US)

(72) Inventor: Catherine C. Curtin, Babylon, NY (US)

( * ) Notice: Subject to any disclaimer, the term of this patent is extended or adjusted under 35 U.S.C. 154(b) by 0 days.

(21) Appl. No.: 16/708,735

(22) Filed: Dec. 10, 2019

(65) Prior Publication Data

US 2020/0390198 A1 Dec. 17, 2020

Related U.S. Application Data

(60) Provisional application No. 62/862,613, filed on Jun. 17, 2019.

(51) Int. Cl.

| | |
|---|---|
| ***A44B 1/42*** | (2006.01) |
| ***B26F 1/32*** | (2006.01) |
| *B26F 1/18* | (2006.01) |

(52) U.S. Cl.

CPC ..... *A44B 1/42* (2013.01); *B26F 1/32* (2013.01); *B26F 1/18* (2013.01); *B26F 2210/12* (2013.01)

(58) Field of Classification Search

CPC ..... A47B 1/42; B26F 1/32; B26F 2210/12; B26F 1/18

See application file for complete search history.

(56) References Cited

U.S. PATENT DOCUMENTS

| | | | | |
|---|---|---|---|---|
| 65,250 A * | 5/1867 | McGill | A44B 1/42 | 24/96 |
| 375,698 A * | 12/1887 | Ewig | A44B 1/42 | 24/96 |
| 457,970 A * | 8/1891 | Mathison | A44B 1/42 | 24/96 |
| 2,462,717 A * | 2/1949 | Brown, Jr. | A44B 1/42 | 24/103 |
| 3,448,495 A * | 6/1969 | Chernack | A44B 1/42 | 24/96 |
| 3,754,304 A * | 8/1973 | Modrey | A44B 1/185 | 24/114.7 |
| 6,442,808 B2 * | 9/2002 | Fildan | A41C 3/00 | 2/265 |
| 2005/0150085 A1 * | 7/2005 | Pak | A44B 1/42 | 24/90.1 |

* cited by examiner

*Primary Examiner* — Robert Sandy

(57) ABSTRACT

A sewing accessory, namely, a button anchor and attachment system, with a button head and an anchor part. The anchor part includes two prongs that are attached to each other and the button head at the back face of the button head. The button anchor is attached to a garment by using a button anchor hole-puncher tool to punch a hole through the garment, inserting the anchor part of the button anchor in a closed position through the hole, and then bending the two prongs of the anchor part apart into an open position. The button anchor hole-puncher tool has a small blade on the front end and a handle on the back end.

15 Claims, 9 Drawing Sheets

BUTTON ANCHOR AND BUTTON ATTACHMENT SYSTEM

CROSS-REFERENCE TO RELATED APPLICATION

The present application is related to and claims priority from prior provisional application Ser. No. 62/862,613, filed Jun. 17, 2019 which application is incorporated herein by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of sewing accessories, specifically buttons. More specifically, the invention is a button anchor that uses a pair of prong-like fasteners to secure the button to a garment rather than requiring a user to sew the button in place. Once inserted through the garment, the fasteners are expanded to secure the button, eliminating the need to sew buttons onto clothing using needle and thread.

2. DESCRIPTION OF THE RELATED ART

Applying or replacing buttons can be difficult. A button is generally attached to a garment via multiple loops of thread, which are sewn through the two to four holes in the button and the garment. This can be done by hand with a needle and thread, which can be time consuming and frustrating, or by certain sewing machines that are programmed to be able to sew buttons, which requires specialized equipment that is often significantly more expensive than the cost of the garment, let alone the button. Some people may even throw away a garment rather than be bothered to replace a missing button.

Various attempts have been made to solve the above-mentioned problems such as those found in U.S. Pat. No. 2,462,717 to M. F. Brown, Jr.; U.S. Pat. No. 3,448,495 to M. P. Chernack, et al.; U.S. Pat. No. 3,754,304 to Henry J. Modrey; U.S. Pat. No. 6,442,808 to Gerhard Fildan et al.; and U.S. Pat. Pub. No 2005/0150085 to Jane Pak. This art is representative of button fasteners. None of the above inventions and patents, taken either singly or in combination, is seen to describe the invention as claimed.

Ideally, a button anchor and button attachment system should provide an easy way of replacing a missing button and, yet would operate reliably and be manufactured at a modest expense. Thus, a need exists for a reliable button attachment system to avoid the above-mentioned problems.

BRIEF SUMMARY OF THE INVENTION

In view of the foregoing disadvantages inherent in the known sewing accessories art, the present invention provides a novel button attachment system. The general purpose of the present invention, which will be described subsequently in greater detail is to provide a quick and easy way for a user to attach a button to a garment. In addition to the above, the button anchor may also be used to tighten loose fitting garments or straps and aid in closing torn or open fabrics.

The button anchor is a thread-less button. The button head can be made of any material, including plastic, metal, wood, coconut, sea shell, and resin. The anchor part is made of two prongs of a bendable metal, such as stainless steel, aluminum, silver, nickel, brass, bronze, copper, and gold. The two tips of the anchor part are blunt or rounded.

At the base of the fastener part is a non-slip band made of plastic or rubber. The band keeps the anchor part from separating all the way to the base at the button head. This prevents the fabric from expanding at the primary buttonhole location and improves the button anchor's securement to the garment.

The button anchor can be attached to any type of fabric or elastic. Fabrics such as cotton, polyester, wool, satin, silk, denim, corduroy, and even canvas.

The button anchor requires a hole-punching tool to create a hole in the fabric, through both an outer and inner layer of fabric if necessary, before the button anchor is inserted into the hole and secured in place with the fastener part. Once the hole is created, the button anchor can be secured in one of two ways: a permanent way, or a temporary way.

The present invention holds significant improvements and serves as a button anchor and button attachment system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures that accompany the written portion of this specification illustrate embodiments and method(s) of use for the present invention, a button anchor and button attachment system, constructed and operative according to the teachings of the present invention.

FIG. 9A being the temporary way and FIG. 9B being the permanent way.

The various embodiments of the present invention will hereinafter be described in conjunction with the appended drawings, wherein like designations denote like elements.

DETAILED DESCRIPTION

As discussed above, embodiments of the present invention relate to buttons and more particularly to a button anchor and button attachment system as used to improve the ease of attaching a button to a garment.

Figure 1:
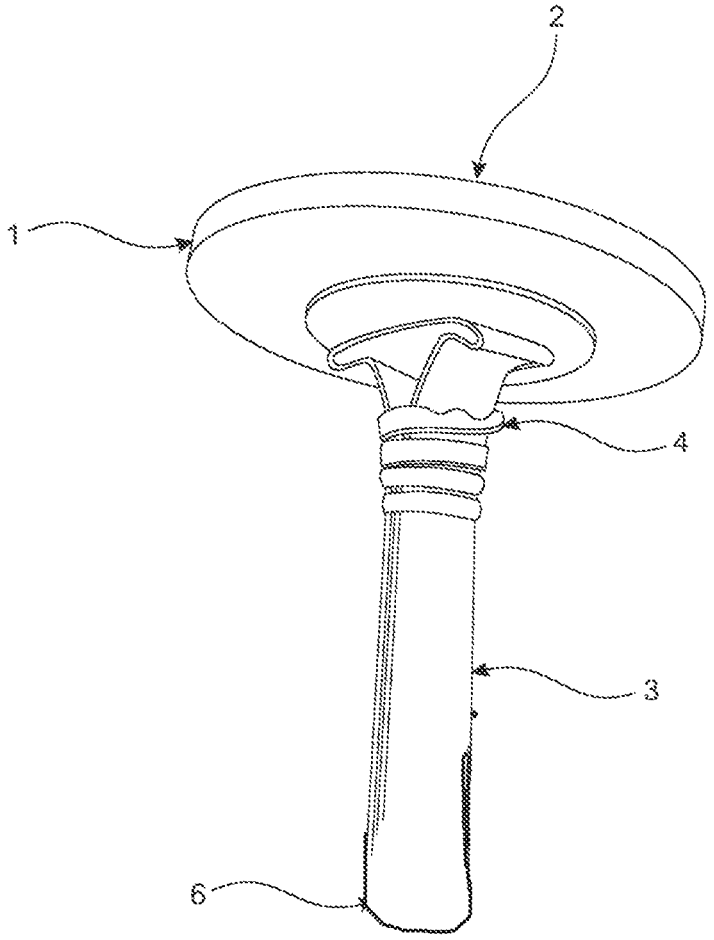
FIG. 1 shows a perspective view illustrating a button anchor according to an embodiment of the present invention.
Figure 2:
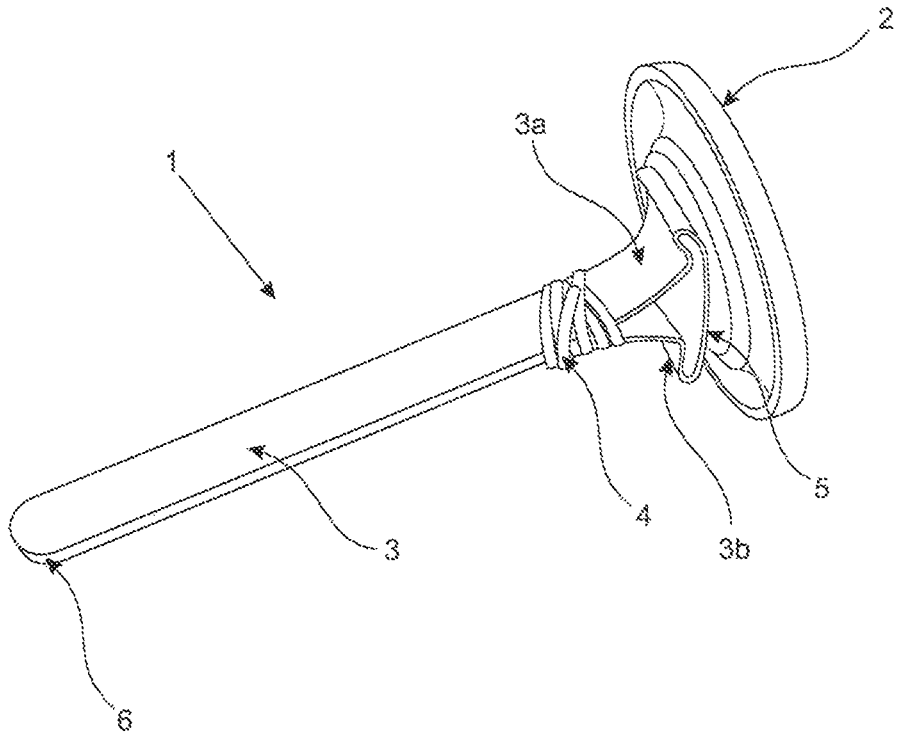
FIG. 2 is a perspective view illustrating a button anchor according to an embodiment of the present invention.

Referring to the drawings by numerals of reference there is shown in FIGS. 1 and 2, a button anchor 1 has a button head 2 that is formed of a button. The button can be made of any material, including but not limited to, plastic, metal, wood, coconut, sea shell, and resin. The button anchor also has an anchor part 3, attached at a base 5 via soldering, welding, bonding, or casting to the button head 2. The anchor part 3 is made of two prongs 3*a*, 3*b* of a bendable metal, such as stainless steel, aluminum, silver, nickel, brass, bronze, copper, and gold. The two tips 6 of the prongs 3*a*, 3*b* of the anchor part 3 are blunt, as shown in FIG. 1, or rounded, as shown in FIG. 2.

Just above the base 5 of the anchor part 3, as the neck, is a non-slip band made of plastic or rubber 4. The band 4 keeps the prongs of the anchor part 3*a*, 3*b* from separating all the way to the base 5 at the button head 2. This prevents the fabric from expanding at the primary buttonhole location when the prongs 3*a*, 3*b* are bent, thereby improving the button anchor's securement to the garment.

Referring now to FIGS. 3-6, the button anchors can be made in a variety of sizes to meet the different requirements of different types of garments. For example, shirt button anchors 101 may have a button head 2 width of 1 cm or 1.25 cm, and length of approximately 3 cm, including the button head 2 and the anchor part 3. A pants button anchor 102 may have a button head 2 width of 2 cm, and a length of approximately 3.75 cm, including the button head 2 and the anchor part 3. A skirt button anchor 103 may have a button head 2 width of 1.75 cm, and a length of approximately 3.75 cm, including the button head 2 and the anchor part 3. A coat button anchor 104 may have a button head 2 width of 2.25 cm, and a length of approximately 4 cm including the button head 2 and the anchor part 3.

Figure 3:
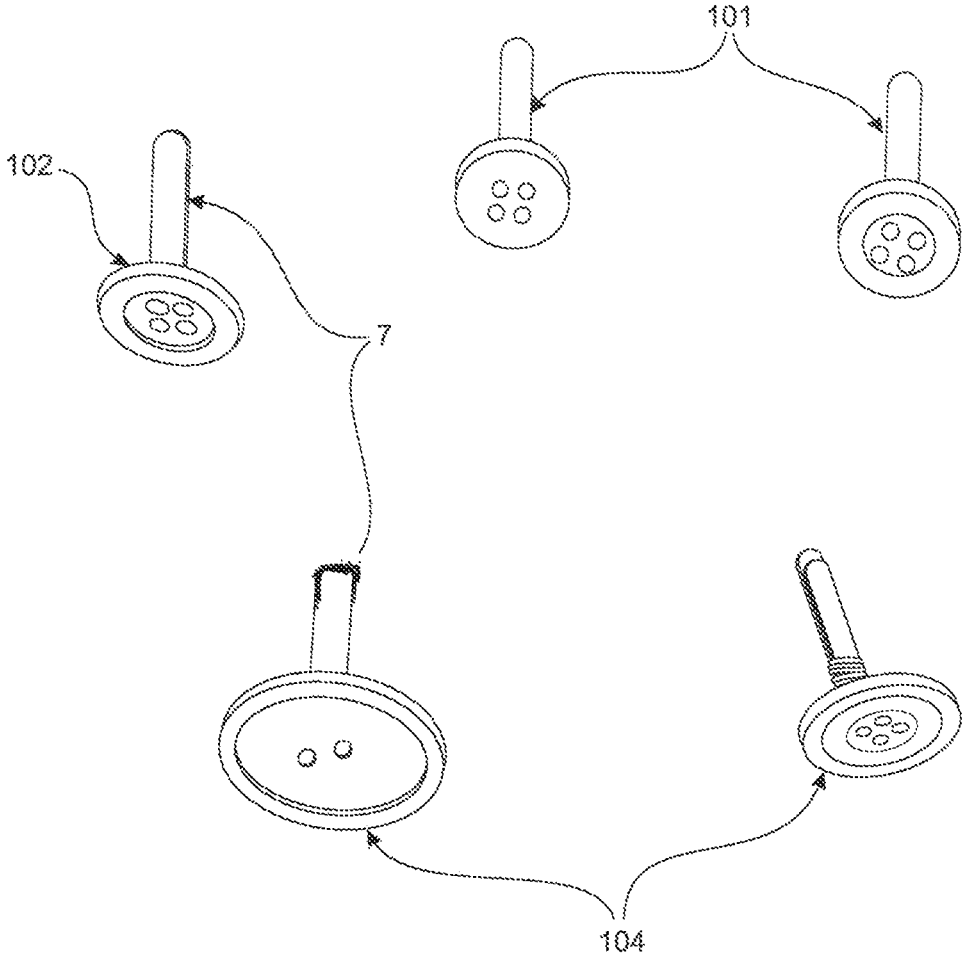
FIG. 3 is a perspective view illustrating different sizes of button anchors with the anchor closed according to an embodiment of the present invention of FIG. 1.
Figure 4:
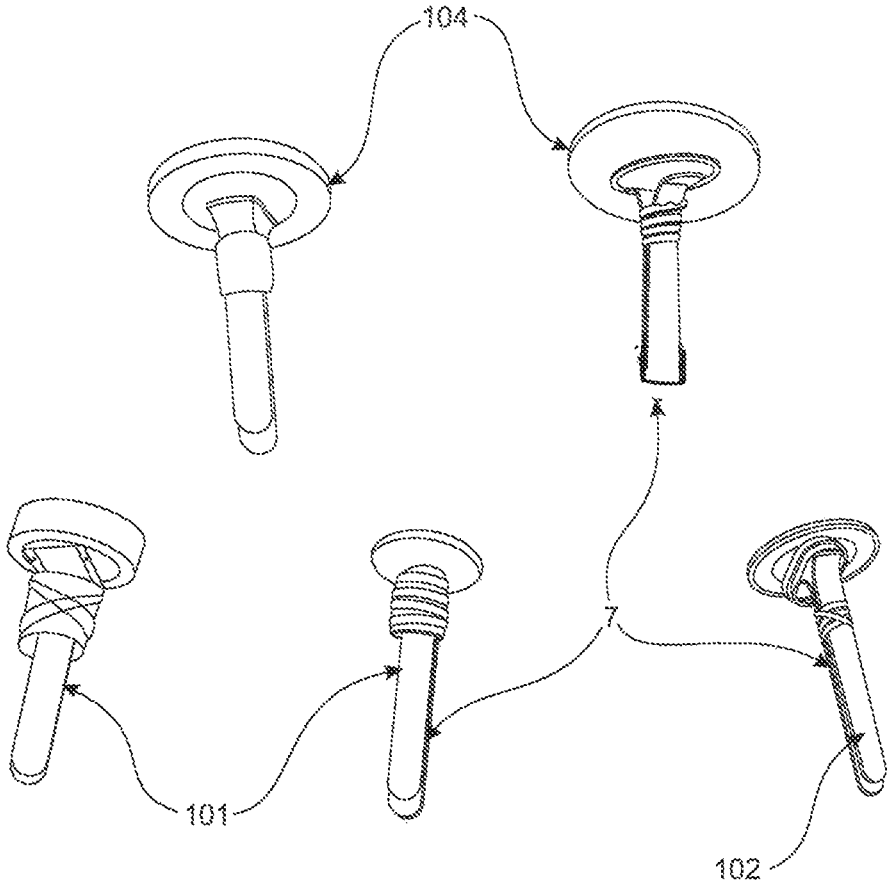
FIG. 4 is a perspective view illustrating different sizes of button anchors with the anchor closed according to an embodiment of the present invention of FIG. 3.

As shown in FIGS. 3-4, when the prongs 3*a*, 3*b* of the anchor part 3 are in a closed position 7, the prongs 3*a*, 3*b* form one long, straight, insertable base that is perpendicular to the face of the button head 2 that is insertable into a small hole in the fabric of a garment.

Figure 5:
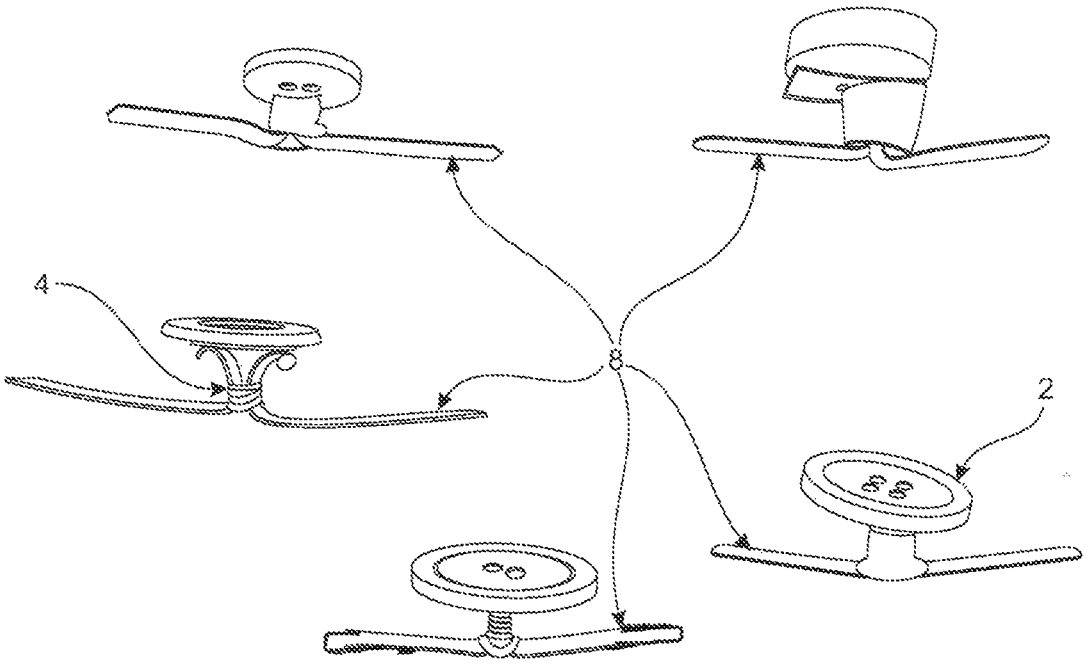
FIG. 5 is a perspective view illustrating different sizes of button anchors with the anchor opened according to an embodiment of the present invention of FIG. 1.
Figure 6:
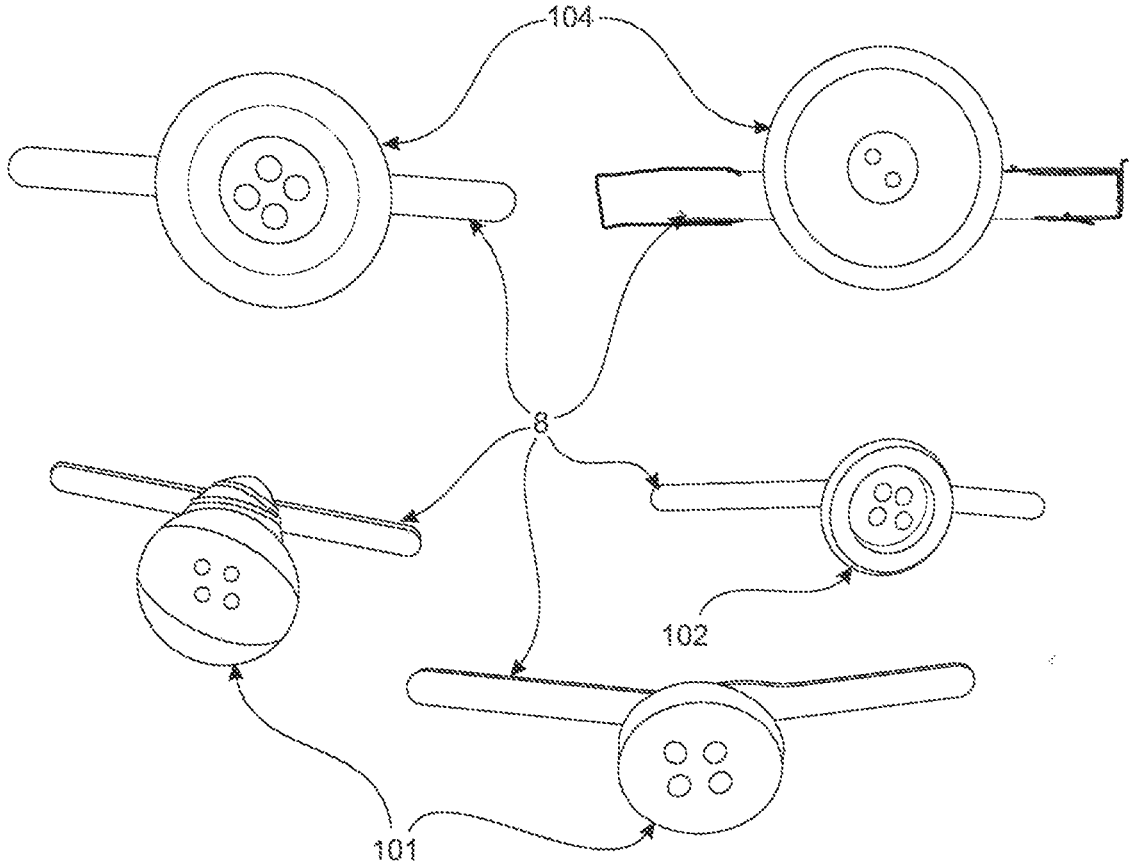
FIG. 6 is a perspective view illustrating different sizes of button anchors with the anchor opened according to an embodiment of the present invention of FIG. 1.

As shown in FIG. 5-6, when the prongs 3*a*, 3*b* of the anchor part 3 are in an open position 8, the band 4 creates a neck just below the base 5 of the button head 2, and the prongs 3*a*, 3*b* extend out in a line from the tip 6*a* of one prong 3*a*, to tip 6*b* of the other prong 3*b*, parallel to the face of the button head 2.

Figure 7:
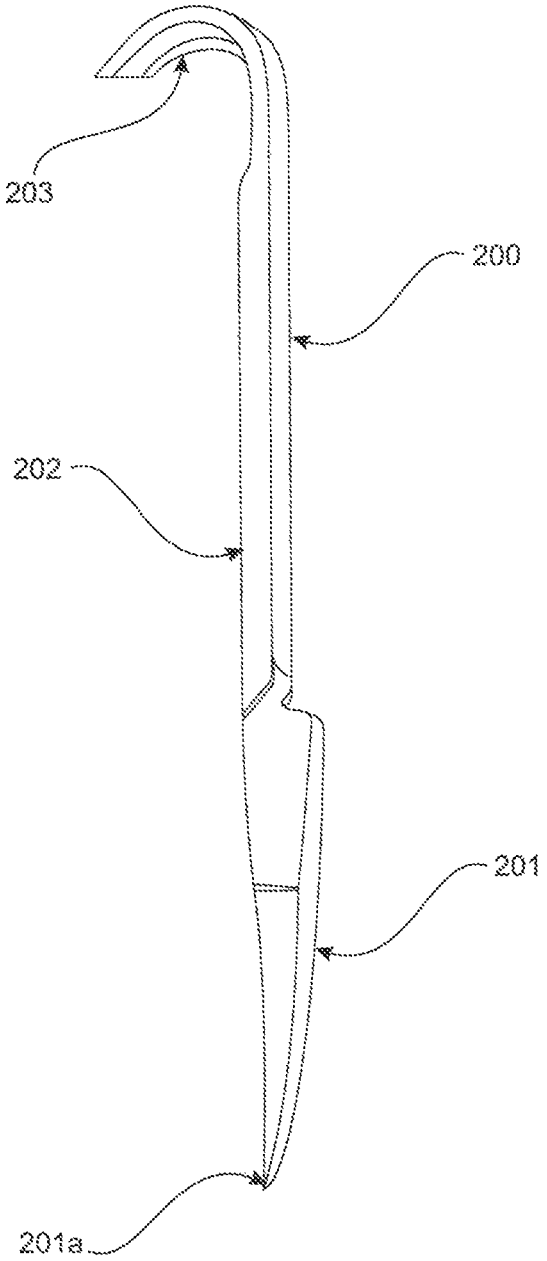
FIG. 7 is a perspective view illustrating the buttonhole puncher according to an embodiment of the present invention.

As shown in FIG. 7, the button anchor hole-puncher tool 200 includes a small blade 201 with a sharp tip 201*a*, preferably with a width of 0.25 cm, and with a curved edge at a 15 degree curved angle. The small blade 201 is at one end of the tool handle 202. The tool handle 202 preferably has a width of 0.5 cm. The button anchor hole-puncher tool 200 has a length of approximately 6 cm, from the sharp tip 201*a* of the small blade 201 to the handle 202.

Figure 8:
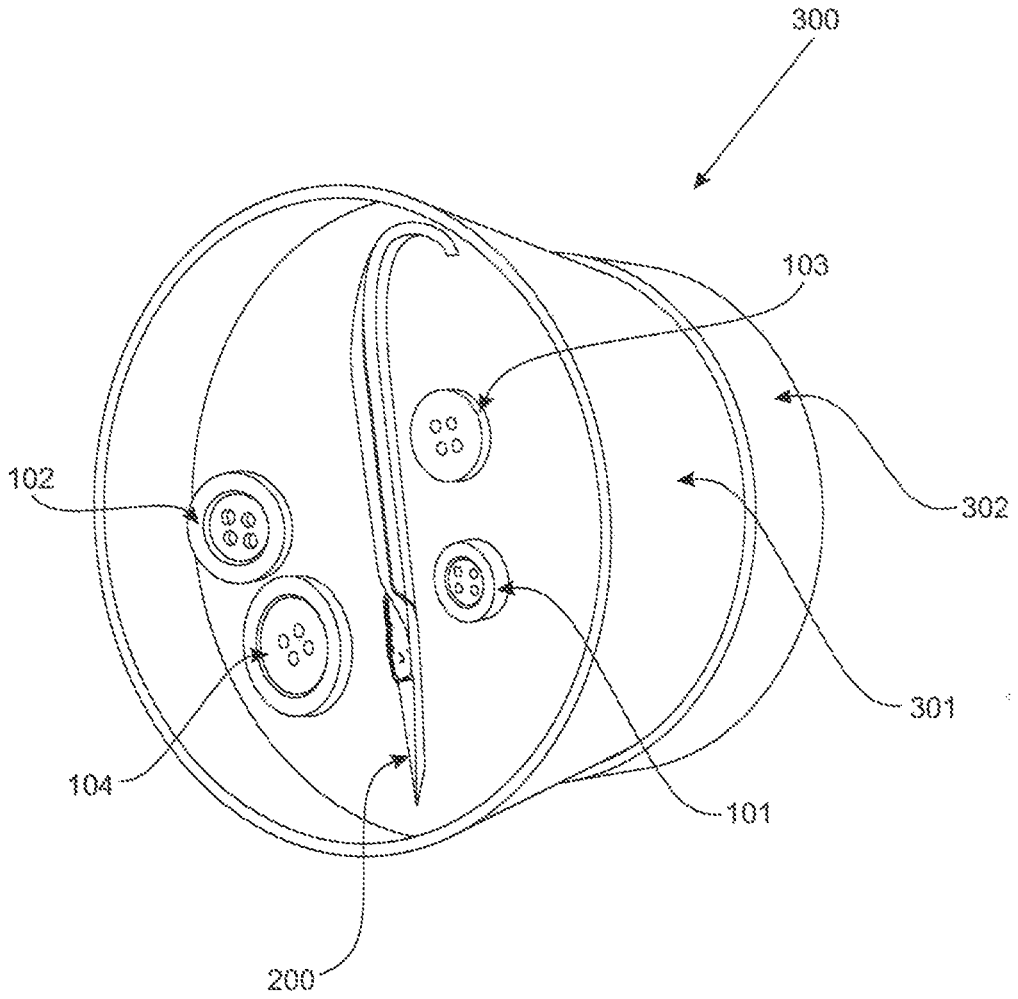
FIG. 8 is a perspective view illustrating a button anchor kit according to an embodiment of the present invention.

Referring now to FIG. 8, one or more button anchors 1 and the button anchor hole-puncher tool 200 may be combined to form a button anchor kit 300. For example, a shirt button anchor 101, a pant button anchor 102, a skirt button anchor 103, and a coat button anchor 104, can be combined with the button anchor hole-puncher tool 200 into a kit 300, possibly including a holding box 301 with a lid 302. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 9A:
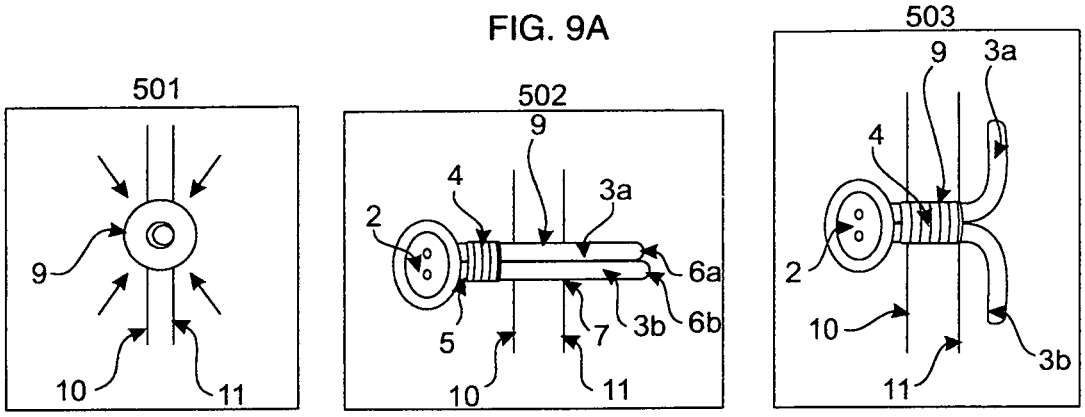
FIG. 9A and FIG. 9B illustrates two methods for attaching a button anchor according to an embodiment of the present invention.
Figure 9B:
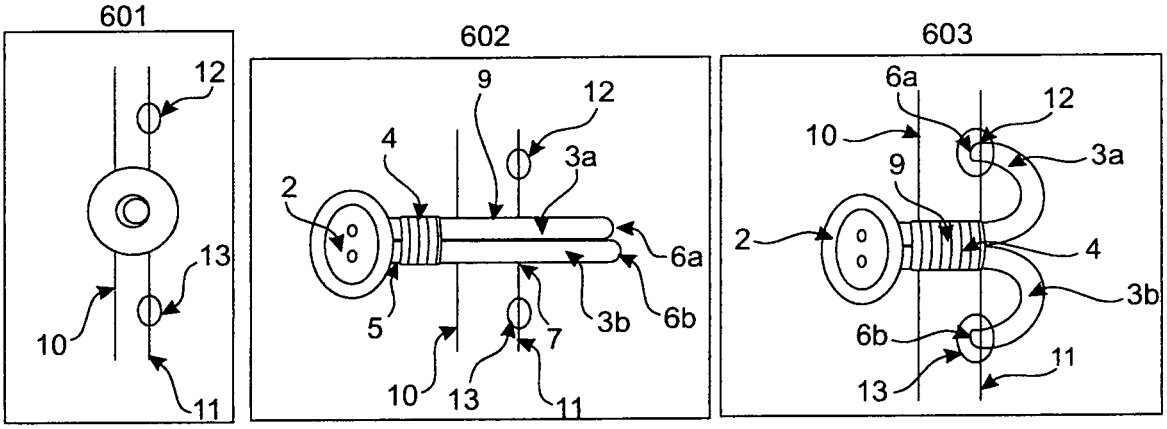
Figure 9B:
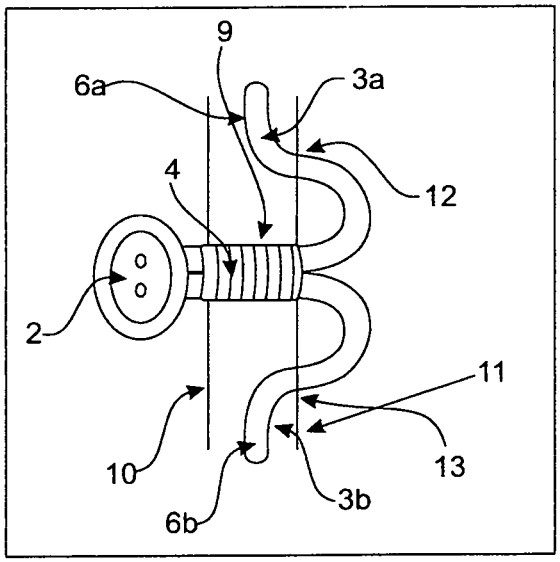

Referring now to FIG. 9, the button anchor requires a hole-punching tool 200 to create a hole 9 in the fabric, through both an outer layer of fabric 10 and inner layer of fabric 11 if necessary, before the button anchor 1 is inserted into the hole 9 and secured in place with the button head 2 on one side of the fabric and the anchor part 3 on the other. Once the hole 9 is created, the button anchor 1 can be secured in one of two ways: a temporary way, as shown in FIG. 9A, or a permanent way, as shown in FIG. 9B.

As shown in FIG. 9A, in the temporary way of attaching the button anchor 1, step 1 501 is to punch a hole 9 through the outer 10 and the inner 11 layer of fabric together using the hole-puncher tool 200. Step 2 502 is to insert the anchor part 3 through the hole 9 with the prongs 3*a*, 3*b* of the anchor part 3 in the closed position 7.

Step 3 503 is to separate the two prongs 3*a*, 3*b* of the anchor part 3 by bending them at right angles at the band 4 so that the anchor part 3 is in the open position 8. The prongs 3*a*, 3*b* are located on the inside of the inner layer of fabric 11, while the button head 2 is located on the outside of the outer layer of fabric 10. This secures the button anchor 1 in place in an easily removable, and thus temporary, fashion. To remove, a user simply straightens the prongs 3*a*, 3*b*, returning the anchor part 3 to the closed position 7, and removes the button anchor 1 from the hole 9.

As shown in FIG. 9B, in the permanent way, step 1 601 is to make the main hole 9 through both the outer 10 and inner 11 layers of fabric using the hole-punching tool 200, and then make two additional holes 12, 13 through only the inner fabric layer 11, to create a line of three holes with the main hole 9, through both the inner and outer fabric layers, in the middle and one of the two the fastener holes 12, 13 on either side. Step 2 602 is exactly the same as in step 2 502 of the temporary way: insert the anchor part 3 through the hole 9 with the prongs 3*a*, 3*b* of the anchor part 3 in the closed position 7.

Step 3 603 is to separate the two prongs 3*a*, 3*b* of the anchor part 3 by bending them at right angles at the band 4 so that the anchor part 3 is in the open position 8. Each tip 6*a*, 6*b* of the prongs 3*a*, 3*b* is inserted into one of the fastener holes 12, 13 located on the inside of the inner layer of fabric 11.

Step 4 604 is to slide the two prongs 3*a*, 3*b* flatly in between the outer 10 and inner 11 fabric layers, while the button head 2 is located on the outside of the outer layer of fabric 10. Thus, the anchor part 3 is mainly located between the outer 10 and inner 11 fabric layers, securing the button anchor 1 permanently.

The use of "step of" should not be interpreted as "step for", in the claims herein and is not intended to invoke the provisions of 35 U.S.C. § 112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A button anchor comprising:
(a) a button head with a front face and a back face;
(b) an anchor part including
(i) a first prong with a first tip;
(ii) a second prong with a second tip; and
(iii) a base,
wherein the base is operably connected to the back face of the button head, and
wherein the first prong and the second prong are operably connected to the base to form a single unit; and
(c) a band, wherein the band is wrapped around both the first prong and the second prong at the base.

2. The button anchor of claim 1,
wherein the band comprises a material selected from the group consisting of rubber and plastic.

3. The button anchor of claim 1,
wherein the button head is comprises a material selected from the group consisting of plastic, metal, wood, coconut, sea shell and resin.

4. The button anchor of claim 1,
wherein the anchor part comprises a bendable metal selected from the group consisting of stainless steel, aluminum, silver, nickel, brass, bronze, copper, and gold.

5. The button anchor of claim 1,
wherein the first tip and the second tip are blunt.

6. The button anchor of claim 1,
wherein the first tip and the second tip are rounded.

7. The button anchor of claim 1,
wherein the button head has a width of 1 cm,
wherein the button anchor has a length from the front face of the button head to the first tip and the second tip, and
wherein the length of the button anchor is 3 cm.

8. The button anchor of claim 1,
wherein the button head has a width of 1.25 cm,
wherein the button anchor has a length from the front face of the button head to the first tip and the second tip, and
wherein the length of the button anchor is 3 cm.

9. The button anchor of claim 1,
wherein the button head has a width of 2 cm,
wherein the button anchor has a length from the front face of the button head to the first tip and the second tip, and
wherein the length of the button anchor is 3.75 cm.

10. The button anchor of claim 1,
wherein the button head has a width of 1.75 cm,
wherein the button anchor has a length from the front face of the button head to the first tip and the second tip, and
wherein the length of the button anchor is 3.75 cm.

11. The button anchor of claim 1,
wherein the button head has a width of 2.25 cm,
wherein the button anchor has a length from the front face of the button head to the first tip and the second tip, and
wherein the length of the button anchor is 4 cm.

12. A button anchor kit comprising:
(a) an assortment of button anchors, each button anchor according to the button anchor of claim 1; and
(b) a button anchor hole-punching tool including
(i) a small blade with a sharp tip;
(ii) a tool handle with
(1) a front end;
(2) a back end; and
wherein the blade is located on the front end and the handle on the back end.

13. The button anchor kit according to claim 12, wherein button anchor kit further comprises:
(c) a holding box.

14. A method of temporarily attaching a button anchor to a garment, the method comprising the steps of:
(a) providing a button anchor according to claim 1;
(b) providing a garment with at least one layer of fabric;
(c) providing a hole-puncher tool with
(i) a small blade with a sharp tip;
(i) a tool handle with
(1) a front end;
(2) a back end; and
wherein the blade is located on the front end and the handle on the back end;
(d) punching a hole through the at least one layer of fabric at a desired location for the button anchor with the hole-puncher tool;
(e) inserting the anchor part of the button anchor in a closed position through the hole in the at least one layer of fabric so that the button head is on an outside of the fabric, and the first prong and the second prong are on an inside of the fabric,
wherein the button anchor is in the closed position when the first prong is together with the second prong in a straight position that is perpendicular to the front fact of the button head;
(f) bending the first prong away from the second prong at the band so the first prong is parallel to the front face of the button head; and
(f) bending the second prong away from the first prong at the band so the second prong is parallel to the front face of the button head.

15. A method of permanently attaching a button anchor to a garment, the method comprising the steps of:

(a) providing a button anchor according to claim 1;

(b) providing a garment with an outer layer of fabric and an inner layer of fabric;

(c) providing a hole-puncher tool with (i) a small blade with a sharp tip;

(i) a tool handle with (1) a front end;

(2) a back end; and wherein the blade is located on the front end and the handle on the back end;

(d) punching a main hole through both the outer layer of fabric and the inner layer of fabric with the hole-puncher tool at a desired location for the button anchor;

(e) punching a second hole through only the inner layer of fabric with the hole-puncher tool, at a right side of the main hole;

(f) punching a third hole through only the inner layer of fabric with the hole-puncher tool, at a left side of the main hole, wherein the second hole, the main hole, and the third hole form a line;

(g) inserting the anchor part of the button anchor in a closed position through the main hole so that the button head is on an outside of the outer layer of fabric, and the first prong and the second prong are on an inside of the inner layer of fabric, wherein the button anchor is in the closed position when the first prong is together with the second prong in a straight position that is perpendicular to the front fact of the button head;

(h) bending the first prong away from the second prong at the band so the first tip is inserted into the second hole;

(i) bending the second prong away from the first prong at the band so the second tip is inserted into the third hole; and (j) sliding the first prong and the second prong flatly in between an inside of the outer layer of fabric and an outside of the inner layer of fabric so that the first prong and the second prong are parallel to the front face of the button head.

* * * * *